United States Patent [19]

Takahashi

[11] 4,196,958

[45] Apr. 8, 1980

[54] CONNECTOR PLUG

[76] Inventor: Hitoya Takahashi, 14-11, 4-chome, Kuramae, Taito-ku, Tokyo, Japan

[21] Appl. No.: 936,029

[22] Filed: Aug. 23, 1978

[30] Foreign Application Priority Data

Mar. 8, 1978 [JP] Japan ..... 53-28399

[51] Int. Cl.[2] ..... H01R 17/18

[52] U.S. Cl. ..... 339/183

[58] Field of Search ..... 339/183, 182 R

[56] References Cited

U.S. PATENT DOCUMENTS

| | | | |
|---|---|---|---|
| 1,302,471 | 4/1919 | Richter | 339/183 |
| 1,673,644 | 6/1928 | Shoe | 339/183 |
| 2,238,834 | 4/1941 | Travers | 339/183 |
| 3,665,367 | 5/1972 | Keller et al. | 339/275 T |

FOREIGN PATENT DOCUMENTS

| | | | |
|---|---|---|---|
| 55168 | 5/1935 | Norway | 339/183 |
| 100074 | 7/1923 | Switzerland | 339/183 |

*Primary Examiner*—Neil Abrams

*Attorney, Agent, or Firm*—Frishauf, Holtz, Goodman and Woodward

[57] ABSTRACT

A connector plug for connection at the end of a cable comprises a plug body of conductive material having a generally tubular common connector extending from an end thereof and integrally formed therewith, and a hole for receiving the end portion of the cable. The common contactor has a substantially central hole extending therethrough and a hot contactor is attached at one end of the common contactor electrically insulated from the common contactor. A connecting member is disposed in the central hole of the common contactor and has one end which is electrically connected to the hot contactor and another end which is located in the interior of the cable receiving hole of the plug body. The connecting member has a receiving portion with an axially extending receiving hole for receiving the tip of one of the conductors of the cable therein. An insulating cap is provided to cover the plug body.

5 Claims, 9 Drawing Figures

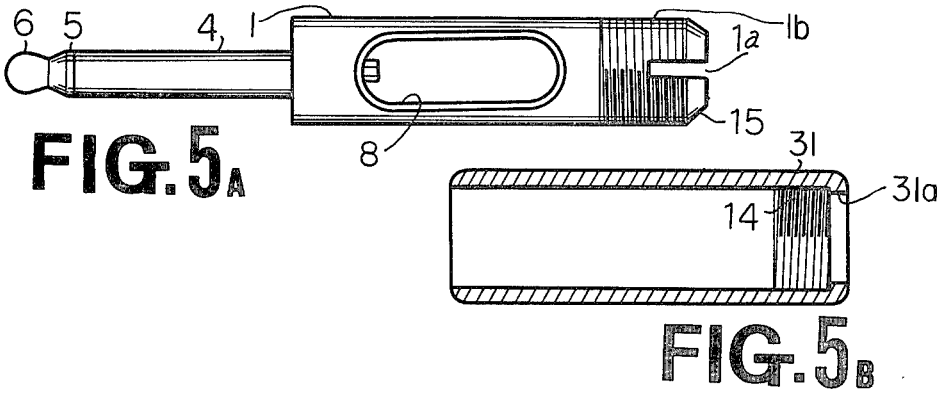
FIG. 5A
FIG. 5B
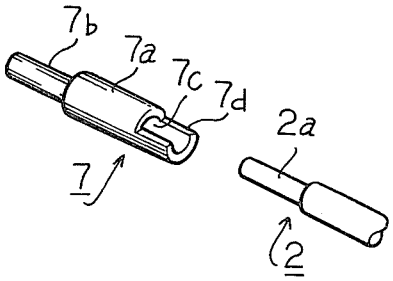
FIG. 6
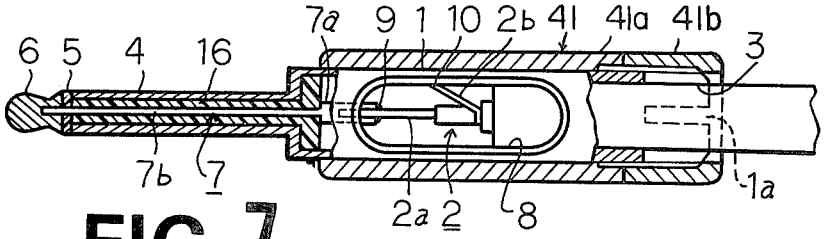
FIG. 7
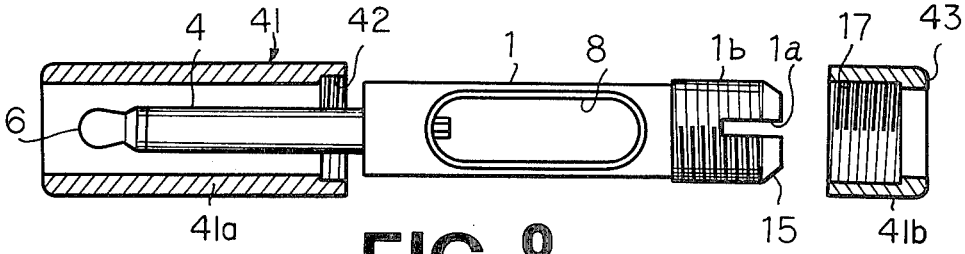
FIG. 8

CONNECTOR PLUG

BACKGROUND OF THE INVENTION

This invention relates to a connector plug for coaxial cables used for electrical connection between electrical equipment such as components of audio systems.

A conventional connector plug attached to the end of a coaxial cable comprises a common contactor integrally formed at the tip end of a plug body and a hot contactor fitted at the end of the common contactor and an insulating member placed between the contactors. A connecting member or rod penetrating through the common contactor is connected at its one end to the hot contactor and has a connecting portion at the other end to which is connected one of the conductors of the cable. The oher conductor is connected to the plug body directly.

In the known connector plug the connecting member has a shape of a simple rod so that it is difficult to determine the correct position on the rod shaped connecting member to which the conductor of the cable is to be connected by soldering. Also, this construction does not give a secure connection therebetween. This results in disconnection of the conductor from the rod due to any shock or the like and in short circuiting between both conductors of the cable.

SUMMARY OF THE INVENTION

The object of this invention is to provide an improved connector plug in which disconnection of the conductor of a cable and short circuiting of the conductors of the cable are prevented.

Therefore, it is an object of this invention to provide a connector plug having a secure connection to the cable conductors.

Another object of this invention is to provide a connector plug having means for securely retaining a cable to the plug, thereby preventing disconnection of the conductors even when the cable is pulled from the plug.

BRIEF DESCRIPTION OF THE DRAWINGS

FIGS. 5A and 5B show a plug body and a cap, respectively, of the plug shown in FIG. 4;

FIG. 6 is a perspective view of the connecting portion of the connecting member and a conductor to be connected thereto;

FIG. 7 is a sectional view of a still further plug embodying this invention; and FIG. 8 shows the disassembled plug shown in FIG. 7.

DESCRIPTION OF THE PREFERRED EMBODIMENTS

Figure 1:
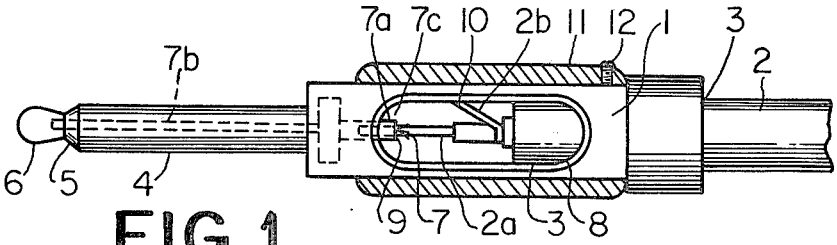
FIG. 1 is a side view, partly cut away, of a connector plug embodying this invention.

Referring now to FIG. 1, the reference numeral 1 generally designates a tubular plug body of conductive material, one end of which is provided with an opening 3 into which a coaxial cable 2 is inserted. The other end of the body 1 is integrally formed with a tubular portion or common contactor 4 having a smaller diameter than the body 1 and extending from the body 1. A hot contactor 6 is securely fitted at the tip end of the common contactor 4, between which is positioned an insulating member 5 to provide electrical insulation between the common contactor 4 and hot contactor 6.

Figure 2:
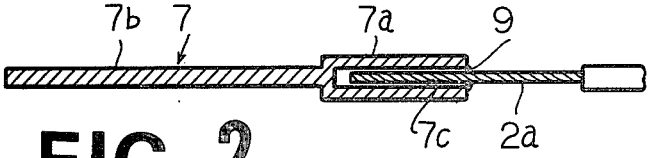
FIG. 2 is a sectional view showing the connecting portion between the connecting member of the plug and a conductor of a cable.

In the central hole or opening 3 of the plug body 1 and the central elongated opening of common contactor 4 is placed an elongated connecting member 7 having portions 7*a* and 7*b*. The portion 7*b* penetrates through the central hole 3 of the contactor 4 and is electrically connected at one end to the hot contactor 6. The other portion 7*a* is positioned in the interior of the hollow body 1 and has at one end a hole 7*c* into which the tip of conductor 2*a* of the cable 2 is inserted and electrically connected thereto by an amount of solder 9. Another conductor 2*b* of the cable 2 is electrically connected to the body 1 by an amount of solder 10. As a result, the conductors 2*a* and 2*b* are electrically connected to the hot contactor 6 and common contactor 4, respectively. In order to facilitate making the electrical connections, there is provided an opening 8 in the side wall of the plug body 1. The structure of the connection of the member 7 and the conductor 2*a* is illustrated in FIG. 2 more in detail.

One of the major advantages obtained through the construction of this invention is that the operation of making the connection between connecting member 7 and the conductor 2*a* of the cable 2 is facilitated. Such connection can be made by inserting the tip of the conductor 2*a* into the hole 7*c* of the receiving portion 7*b* and then soldering them to make an electrical and mechanical connection. The hole 7*c* will serve as a guide to insert the tip of the conductor 2*a*. Preferably, the portion 7*a* of the member, as shown in FIG. 6, may be cut out to form a lip 7*d* which aids to easily insert the tip of the conductor 2*a* of the cable 2 as well as facilitates to cause an amount of molten solder to flow into the hole 7*c*.

Figure 3:
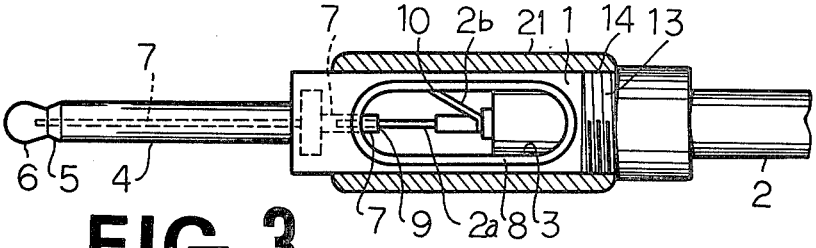
FIG. 3 shows a side view, partly cut away, of another plug embodying this invention.

Furthermore, a tubular cap 11 of an insulating material is attached so as to cover the peripheral surface of the body 1 and is securely fixed in position by means of a screw 12. Alternatively, a cap 21, as shown in FIG. 3, may be secured by means of threads 13 and 14 formed on the body 1 and the cap 21, respectively. The latter arrangement is convenient in the sense that the attaching and detaching operation of the cap can easily be performed and there is no fear of losing the fitting screw 21.

Figure 4:
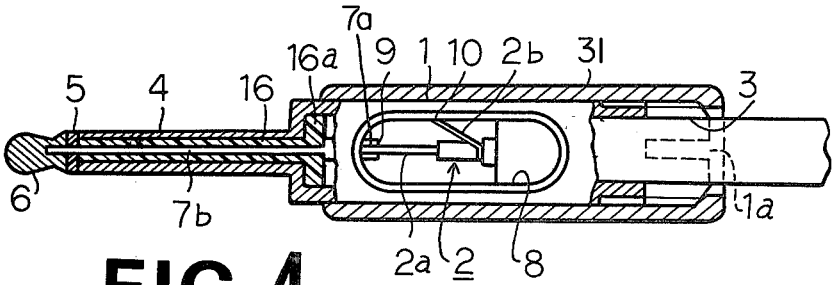
FIG. 4 is a cross sectional view of a further plug embodying this invention.

FIGS. 4, 5A and 5B illustrate a modified connector plug embodying this invention. As clearly shown in FIG. 5A, the plug body 1 is provided with an end portion having a plurality of slits 1*a*, each of which axially extends from the end of the body 1 to form flexible portions which are inwardly movable. A thread 1*b* formed on the peripheral surface of the slit end portion is provided for engagement with a thread 14 formed on the inner surface of the cap 31 by inserting the body 1 into the central hole of the cap and turning it in a predetermined direction. The cap 31 has at its rearmost end a flange 31*a* extending inwards. The flange 31*a* will press the flexible portions at tapered surfaces 15 formed at the rearmost end of the body 1 when the body 1 is forcedly screwed into the cap 31, resulting in decreasing in the diameter of the end of the body 1 to tighten against the cable penetrating through that portion of the body. In this state the cable 2 can not move in the axial direction and also can not rotate around its axis relative to the plug.

In the embodiment shown in FIG. 4, an insulator tube 16 is placed in the space between the common contactor 4 and the connecting member 7. The insulator tube 16 has a flange portion 16*a* at an end thereof which is disposed in the interior of the body 1 and hold the free end 7*a* of the connecting member 7 in position.

In FIGS. 7 and 8 is shown another connector plug embodying this invention which has a modified cap. Namely, the cap 41 utilized in this embodiment comprises two parts 41*a* and 41*b*. The part 41*a* of the cap is shaped in a tubular form and has a thread 42 at one end thereof for engagement with the thread 1*b* of the body 1. The second part 41*b* of the cap is also shaped in a tubular form and has a thread 17 on the inner surface thereof and a flange 43 of the same type as flange 31*a* of the embodiment shown in FIGS. 4 and 5B. The first and second parts 41*a* and 41*b* of the cap are screwed on from the opposite sides of the body 1 so as to cause the threads 42 and 17 to engage with the same thread 1*b* on body 1.

According to the embodiment shown in FIGS. 7 and 8, the operation for connecting the cable to the plug comprises screwing the part 41*b* to the body 1 and then attaching the part 41*a* after the respective connection of the conductors 2*a* and 2*b* to the member 7 and body 1 has been made. Therefore, the cable will not be twisted during the operation of attaching the cap 41 to the body 1.

What is claimed is:

1. A connector plug for connection at the end of a cable and electrically connected to the ends of conductors of said cable, comprising:

a plug body (1) of conductive material having a generally tubular common contactor (4) extending from an end thereof and and integrally formed therewith, and a hole (3) for receiving the end portion of a cable, said common contactor having a substantially central hole;

a hot contactor (6) attached at one end of said common contactor (4) and electrically insulated from said common contactor, said hot conductor having a non-threaded hole therein;

an elongated connecting member (7) disposed in the central hole of said common contactor and having one non-threaded end which is forcibly slidably received in said hole of said hot contactor to electrically and mechanically contact said hot contactor, and another end which is located in the interior of said cable receiving hole (3) of said plug body, said connecting member (7) having a receiving portion (7*a*) with an axially extending receiving hole (7*c*) for receiving the tip of one of said conductors therein; and said plug body having a threaded portion (1*b*) at the end thereof opposite to said common contactor, a plurality of slits (1*a*) in said plug body extending axially of said plug body from said end opposite said common connector to form a plurality of inwardly movable flexible portions and a tapered surface (15) at the end of each of said flexible portions; and a cap (11) of an insulating material covering said plug body (1), said cap having first and second parts (41*a*, 41*b*), each cap part having a respective threaded portion which threadably engages with said threaded portion (1*b*) of said plug body, one of said cap parts (41*b*) having an inwardly extending flange (43) for pressing against said tapered surfaces (15) of said flexible portions of said plug body to inwardly bend said flexible portions.

2. A connector plug as defined in claim 1 wherein said receiving portion (7*a*) of said connectmember has a lip (7*d*) extending from the end thereof.

3. A connector plug as defined in claim 1 wherein said plug body has an access opening therein through which the operation of connecting the tips of said conductor to said receiver portion can be made from outside.

4. A connector plug as defined in claim 1 further comprising an insulating tube mounted between said common contactor and said connecting member.

5. A connector plug as defined in claim 1 wherein said first and second cap parts (41*a*, 41*b*) are threadably engaged with said threaded portion (1*b*) of said plug body from opposite ends of said plug body.

* * * * *